United States Patent [19]

Lotte

[11] 4,038,919

[45] Aug. 2, 1977

[54] DOCTOR BLADE HOLDERS FOR SCREEN PROCESS PRINTING MACHINES

[75] Inventor: André M. Lotte, Mulhouse, France

[73] Assignee: Societe Alsacienne de Constructions Mecaniques de Mulhouse, Mulhouse Cedex, France

[21] Appl. No.: 654,775

[22] Filed: Feb. 3, 1976

[30] Foreign Application Priority Data

Feb. 25, 1975 France ..... 75.05749

[51] Int. Cl.[2] ..... B41F 15/44

[52] U.S. Cl. ..... 101/120; 15/256.5

[58] Field of Search ..... 101/119, 120, 123, 124, 101/157, 169; 15/256.5, 256.51, 236 R, 245

[56] References Cited

U.S. PATENT DOCUMENTS

| | | | |
|---|---|---|---|
| 3,121,904 | 12/1964 | Scott | 101/157 X |
| 3,624,860 | 12/1971 | Grimsten et al. | 101/169 X |
| 3,795,188 | 3/1974 | Giani | 101/119 |
| 3,800,357 | 4/1974 | Skytta | 15/256.51 |
| 3,878,780 | 4/1975 | Lotte | 101/119 |
| 3,930,445 | 1/1976 | Jaffa | 101/120 |

*Primary Examiner*—Edgar S. Burr
*Assistant Examiner*—R. E. Suter

[57] ABSTRACT

In a screen process printing machine, one edge of the doctor blade is firmly held in position against a supporting member. A rigid U-section supporting bar which is secured to the supporting member at one or two points bears on the top face of the active edge of the doctor blade, thus ensuring that the active edge is applied against a rotary cylindrical screen under uniform pressure.

4 Claims, 3 Drawing Figures

FIG. 2
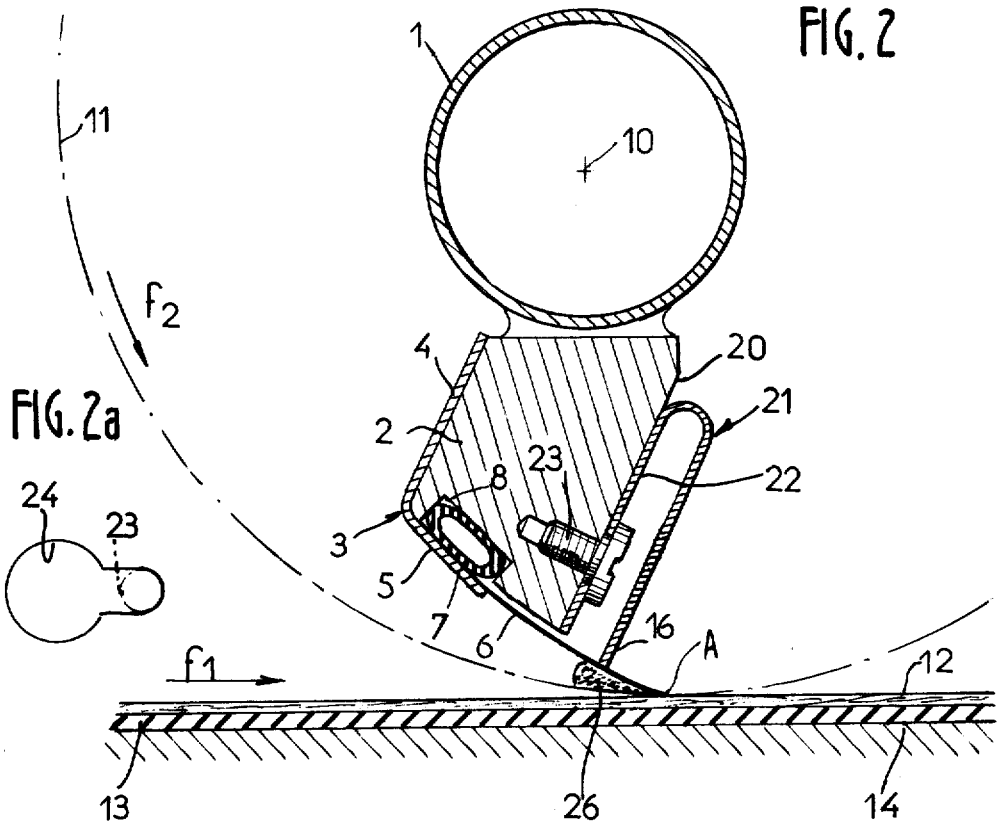
FIG. 2a
FIG. 1
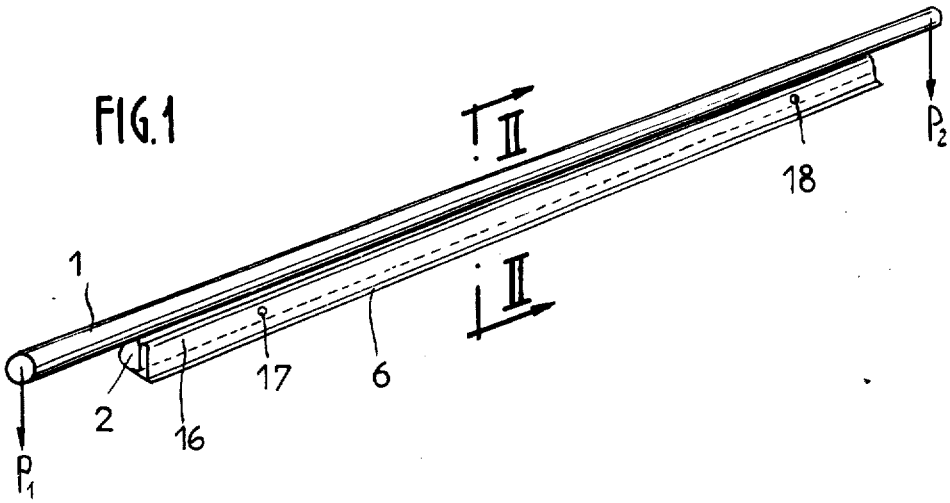

DOCTOR BLADE HOLDERS FOR SCREEN PROCESS PRINTING MACHINES

FIELD OF THE INVENTION

This invention relates to doctor blade holders in screen process printing machines, especially of the type in which cylindrical screens ae employed. In these machines a doctor blade holder is placed within the interior of each screen and extends along the entire length of this latter. Outside the screen and at both ends, the blade holder is provided with extensions which serve to maintain and subject this latter to forces which are capable of applying the doctor blade against the internal face of the screen with the pressure which is necessary for correct operation of the machine.

BACKGROUND OF THE INVENTION

The blade holder is subjected at the two ends which are located outside the screen to the action of the above-mentioned forces of application of the doctor blade against the screen whilst the remainder of its length is subjected by means of the doctor blade to the reaction of the screen which bears on the material being printed. However, by reason of the fact that the blade holder is housed within the interior of the cylindrical screen, it has a substantial length with respect to its cross-section. In consequence, the blade holder is subject to a certain bending stress which makes it concave in a downward direction; thus the doctor blade which is usually fixed along the bottom portion of said blade holder has a corresponding concavity and there is an attendant disadvantage in the resultant lack of uniformity of pressure applied to the screen by the different points along the length of the doctor blade. This in turn results in defective operation, especially in faulty distribution of the color which flows through the screen along the generator-line of contact between the screen and the material to be printed.

SUMMARY OF THE INVENTION

The aim of the invention is precisely to ensure that the doctor blade is applied against the screen under uniform pressure along its entire length in spite of possible flexural deformations of the blade holder.

To this end and in accordance with the invention, a rigid supporting bar is attached at one or two points against the blade holder and is applied against the top face of said doctor blade in the vicinity of that edge of this latter which is in contact with the screen.

By virtue of this particular structure, the rigid bar which is attached to the blade holder at only one or two points is not subjected to the flexural deformations of this latter and its straight edge exerts a uniform pressure along a straight line on the top face of the active edge of the doctor blade, thus providing favorable conditions for ensuring that the active edge of the doctor blade is applied with uniform pressure over the entire length of the straight line contituted by the generator-line of contact between the screen and the material to be printed in spite of possible flexural deformations of the blade holder.

A better understanding of the invention will be gained from the following description and from the accompanying drawings in which one embodiment of an improved doctor blade holder in accordance with the invention is shown by way of example without any limitation being implied, and in which:

DESCRIPTION OF THE FIGURES OF THE DRAWING

FIG. 1 is a general view of the doctor blade holder in general perspective;

FIG. 2 is a view to a larger scale and showing the doctor blade holder in transverse cross-section, this view being taken along line II—II of FIG. 1.

FIG. 2*a* is an enlarged elevation illustrating the type of slot in which the fastener 23 cooperates.

DESCRIPTION OF A PREFERRED EMBODIMENT

The doctor blade holder for a screen process printing machine as illustrated in FIGS. 1 and 2 essentially constituted by a tube 1 along which is fixed a slightly shorter elongated sectional member or doctor holder body 2 having a cross-section in the shape of a quadrilateral. A flange 4 of an L-section member 3 is fixed against one face of said member whilst the other flange 5 serves as a bearing face for one of the two side portions of a doctor blade 6 constituted by a strip of suitable material which is both thin and flexible such as metal or plastic material, for example. Said side portion of the doctor blade is maintained firmly applied against the internal face of the flange 5 of the L-section member 3 by means of an air bladder 7 which is fitted within a longitudinal groove 8 formed in the bottom face of the sectional member 2.

The other side portion of the doctor blade 6 is its active portion, the edge of which is applied against the internal face of a cylindrical screen 11 at the location of the generator-line A of contact between said screen and the material 12 to be printed which is bonded to a carrier belt 13. Said carrier belt is capable of moving in the direction of the arrow f1 along a table 14 in a direction at right angles to the axis 10 of the screen 11 which surrounds the complete doctor blade and blade-holder assembly and rotates in the direction of the arrow f2.

The pressure applied by the doctor blade 6 against the screen 11 is produced by a rigid undeformable doctor-backing bar 16 which is attached to the sectional member 2 at two points 17, 18.

The bar 16 is constituted by a U-section member 21 having unequal flanges, the flange which has the greater length being intended to constitute said bar 16. The flange 22 which has a shorter length in cross-section serves to attach the member 21 against the face 20 of the sectional support member 2 by means of two screws 23 passed through two elongated or buttonhole slots 24 which are formed in the flange 22 in order that said member may be readily detached as shown in FIG. 2*a*. The screws 23 are of a shoulder type, as shown, in order to enable the neighboring portion of member 2 locally to pivot with respect to member 21.

The operation is as follows:

The color is supplied in the usual manner through a suitably perforated support tube 1 and flows to a point located between the active side portion of the doctor blade 6 and the screen 11 as shown at 26. In order to ensure that the doctor blade 6 is applied against the screen 11 with the necessary force to enable the color to pass through said screen, downwardly directed vertical forces P1, P2 are applied on the two ends of the tube 1 as shown in FIG. 1. The active side portion of the doctor blade 6 is subjected by the screen 11 to the upwardly directed vertical reaction which is produced by the table 14, the moving carrier belt 13 and the material 12 to be printed, with the result that the assembly which supports the doctor blade, namely the tube 1 and the sectional member 2, are subjected to bending stresses which give them a downwardly directed concavity. The result thereby achieved is that, if the doctor blade 6 were maintained solely by these members, said blade would also be subjected to the influence of this flexural deformation and the pressure applied by its active edge against the screen would be higher towards the ends than in the intermediate portion of the blade. This would result in lack of uniformity in the flow of color to the screen 11 over the entire length of the contact generator-line A. On the contrary, in accordance with the invention, the rigid bar 16 is attached to the member 2 of the blade holder only at the two points 17 and 18 thereof in such a manner that said member 2 is able locally to pivot on said screws relative to the doctor-backing bar and, therefore, to bend while the rigid doctor-backing bar remains undeformed. In other words, the rigid doctor-backing bar is not subjected to the aforesaid flexural deformations and the bottom edge of its flange 16 remains rectilinear. In consequence, the active side portion of the doctor blade 6 is urged against the screen 11 by a wholly rectilinear element which is parallel to the generator-line A irrespective of the deformations of the member 2 which supports said doctor blade. The pressure exerted by the active edge of the blade is therefore uniform over the entire length of the contact generator-line A.

Very good results have been obtained by giving the distance between the two points 17, 18 of attachment of the bar 16 to the blade holder a value which is substantially equal to 0.5537 *l*, where *l* is the length of the bar 16.

It would also be possible to attach the supporting bar 16 to the blade holder only at one point of its length, that is, at the mid-point of said blade holder. This arrangement would offer the advantage of automatically ensuring pressure equalization of both halves of the length of the doctor blade which is applied against the screen. It would then be possible to add elements for guiding the ends of the bar 16 with respect to the blade holder in order to maintain the bar applied against the corresponding face 20 of this latter.

It is readily apparent that the invention is not limited to the embodiment described with reference to the accompanying drawings and that, depending on the applications which are contemplated, a number of alternative arrangements within the capacity of anyone versed in the art may accordingly be devised without thereby departing either from the scope or the spirit of the invention.

Thus the system of rapid attachment and removal of the bar 16 by means of screws and buttonhole slots can be replaced by any suitable attaching system. Although not shown in the drawings, two holes for insertion of the screws 23 can also be formed in the longest flange of the bar 16.

I claim:

1. An apparatus for use with a printing machine having a screen, comprising:

an elongated doctor-holder body;

a doctor including an elongated strip of thin flexible material having a longitudinal securing marginal portion secured to said doctor-holder body and an opposite longitudinal free wiping marginal portion having one side to be operably engaged against the screen of said printing machine; and a rigid undeformable doctor-backing bar positively attached to said doctor-holder body at at least one and no more than two separate points along said doctor-holder body for possible deformation of said doctor-holder body relative to said doctor-backing bar at said points to allow said doctor-holder body to be able to bend while said rigid doctor-backing bar remains undeformed, said doctor-backing bar having a free edge, said free edge being applied against said longitudinal free wiping marginal portion of said doctor on the side of said longitudinal free wiping portion remote from said screen.

2. The structure as claimed in claim 1, in which said doctor-backing bar is U-shaped in cross-section comprising two flanges, one flange being secured to said doctor-holder while the other flange having said free edge being against an intermediate portion of said longitudinal free wiping marginal portion of said doctor.

3. The structure as claimed in claim 1, in which said doctor-backing bar is secured to said doctor-holder at two longitudinally-spaced points separated by a distance equal to 0.5537 of the length of said doctor-backing bar.

4. An apparatus for use with a printing machine having a screen, comprising:

and elongated doctor-holder body;

a doctor including an elongated strip of thin flexible material having a longitudinal securing marginal portion secured to said doctor-holder body and an opposite longitudinal free wiping marginal portion having one side to be operably engaged against the screen of said printing machine;

a rigid undeformable doctor-backing bar having an edge, said edge being applied against said longitudinal free wiping marginal portion of said doctor on the side of said longitudinal free wiping portion remote from said screen, said doctor-holder body having at least one and no more than two screw-threaded holes along the length of said doctor-holder body, said rigid undeformable doctor-backing bar having a buttonhole slot in register with each said screw-threaded hole in said doctor-holder body; and a screw extending through each said buttonhole slot and being engaged in each said screw-threaded hole for positively attaching said doctor-backing bar to said doctor-holder body, whereby said doctor-holder body is able to deform on said screws relative to said doctor-backing bar and, therefore, to bend while said rigid doctor-backing bar remains undeformed.

* * * * *